US005960770A

United States Patent [19]

Taue et al.

[11] Patent Number: 5,960,770

[45] Date of Patent: Oct. 5, 1999

[54] MULTI-CYLINDER ENGINE OF CRANKCASE SCAVENGING TYPE FOR WATERCRAFT

[75] Inventors: June Taue; Kenji Mori, both of Iwata, Japan

[73] Assignee: Yamaha Hatsudoki Kabushiki Kaisha, Iwata, Japan

[21] Appl. No.: 08/832,416

[22] Filed: Apr. 2, 1997

[30] Foreign Application Priority Data

Apr. 2, 1996 [JP] Japan ..... 8-079953

[51] Int. Cl.[6] ..... F02B 33/26; F02B 21/02

[52] U.S. Cl. ..... 123/317; 123/197.3

[58] Field of Search ..... 123/316, 317, 123/318, 73 R, 73 V, 197.3, 197.4, 195 P, 196 W

[56] References Cited

U.S. PATENT DOCUMENTS

| | | | |
|---|---|---|---|
| 5,016,439 | 5/1991 | Nitta | 60/310 |
| 5,261,356 | 11/1993 | Takahashi et al. | 123/41.31 |
| 5,377,634 | 1/1995 | Taue | 123/317 |

*Primary Examiner*—Willis R. Wolfe
*Assistant Examiner*—Brian Hairston
*Attorney, Agent, or Firm*—Knobbe, Martens, Olson & Bear LLP

[57] ABSTRACT

A multi-cylinder engine of a crankcase scavenging type suitable for use in watercraft. The engine has a very compact arrangement so that it can be used in either an outboard motor or as the prime mover for a watercraft such as a personal watercraft, to embodiments of which are illustrated.

21 Claims, 9 Drawing Sheets

F

MULTI-CYLINDER ENGINE OF CRANKCASE SCAVENGING TYPE FOR WATERCRAFT

BACKGROUND OF THE INVENTION

This invention relates to an internal combustion engine and more particularly to an improved high performance compact multi-cylinder engine of a crankcase scavenging type suitable for use in watercraft.

A wide variety of marine propulsion systems for propelling watercraft employ two-cycle internal combustion engines as their power plants. One reason why two-cycle engines are utilized for these applications is because of their high specific output and relatively compact size. In substantially all watercraft applications, particularly those of the smaller type of pleasure craft and utility craft, the space available for the engine is quite restricted. Therefore, it is desirable to be able to utilize an engine that has high specific output and a compact configuration. This is particularly true in connection with outboard motors. As is well known, with an outboard motor the engine is positioned in the powerhead and the outboard motor is normally mounted in the transom of the watercraft which it propels. This obviously requires a compact power plant.

The compact and simple nature of two-cycle engines, however, gives rise to certain problems. Because of the scavenging system employed and the inherent overlap in the port timing, it is more difficult to control the exhaust emissions with two-cycle engines, particularly when the engine runs over a wide variety of speeds and loads. In addition, the lubricating system employed with two-cycle engines can, at times, also give rise to emission problems.

Therefore, there is an increasing desire to substitute four-cycle engines for two-cycle engines in watercraft propulsion systems. This trend is arising not only in outboard motors but also in the power plants for small watercraft such as personal watercraft that have also normally used two cycle engines. However, these applications do require compact engines and engines that provide high power outputs for their size.

It is, therefore, a principal object of this invention to provide an improved and compact power plant arrangement for propelling vehicles such as watercraft.

It is a further object of this invention to provide an improved, compact and yet high output engine that can be utilized for marine propulsion.

It is a still further object of this invention to provide an improved high output compact four-cycle internal combustion engine and watercraft propulsion system utilizing such an engine.

An engine which has the capability of providing high specific output is disclosed in U.S. Pat. No. 5,377,634 entitled "Compressor System For Reciprocating Machine", issued Jan. 3, 1995 in the name of the one of the inventors hereof and which application is assigned to the Assignee hereof. In that patent, however, the engine has a relatively large overall dimension even though it provides a high power output for its displacement. Also, that patent illustrates only a single cylinder engine and in many applications, multiple cylinder engines are desirable.

It is, therefore, a still further object of this invention to provide an improved engine of the type shown in that patent that has a compact induction and exhaust system and which employs multiple cylinders.

SUMMARY OF THE INVENTION

A first feature of this invention is adapted to be embodied in a reciprocating machine that is comprised of a cylinder block having a plurality of cylinder bores with crankcase chambers formed at one end thereof and a cylinder head that closes the other end of the cylinder bores. Each of a plurality of pistons reciprocate in a respective one of the cylinder bores and form with the cylinder bores and the cylinder head a plurality of combustion chambers. A crankshaft is rotatably journaled in the crankcase chamber and is driven by the pistons through a plurality of connecting rods. Means provide a seal between one end of each of the connecting rods and the respective one of the pistons and between the sides of the connecting rod and the side surfaces of the crankcase chamber. The connecting rods each have a portion thereof which is in sealing engagement with the crankcase during at least a portion of a single rotation of the crankshaft for dividing the crankcase chamber into a plurality of pairs of variable volume chambers formed solely by the pistons, the cylinder bores, the connecting rods, the crankshaft and the crankcase chamber for acting as positive displacement pump. Intake means admit an air charge to the crankcase chambers at one side of the engine. A compressor chamber is located at the other side of the engine for receiving the compressed charge. The cylinder head has a plurality of intake passages on the other side of the engine for serving the combustion chambers. Means located entirely on the other side of the engine are provided for supplying the compressed charged from the compressor chamber to the intake ports. A plurality of exhaust passages are formed in the cylinder head on the one side of the engine for discharging exhaust products from the combustion chambers. An exhaust manifold is formed on the one side of the engine for collecting the exhaust gases for the exhaust passages.

Another feature of the invention is adapted to be embodied in a marine propulsion system having an engine of the type described in the preceding paragraph. The crankshaft is coupled to a marine propulsion device for propelling an associated watercraft.

DETAILED DESCRIPTION OF THE PREFERRED EMBODIMENTS OF THE INVENTION

The Outboard Motor (FIGS. 1–4)

Figure 1:
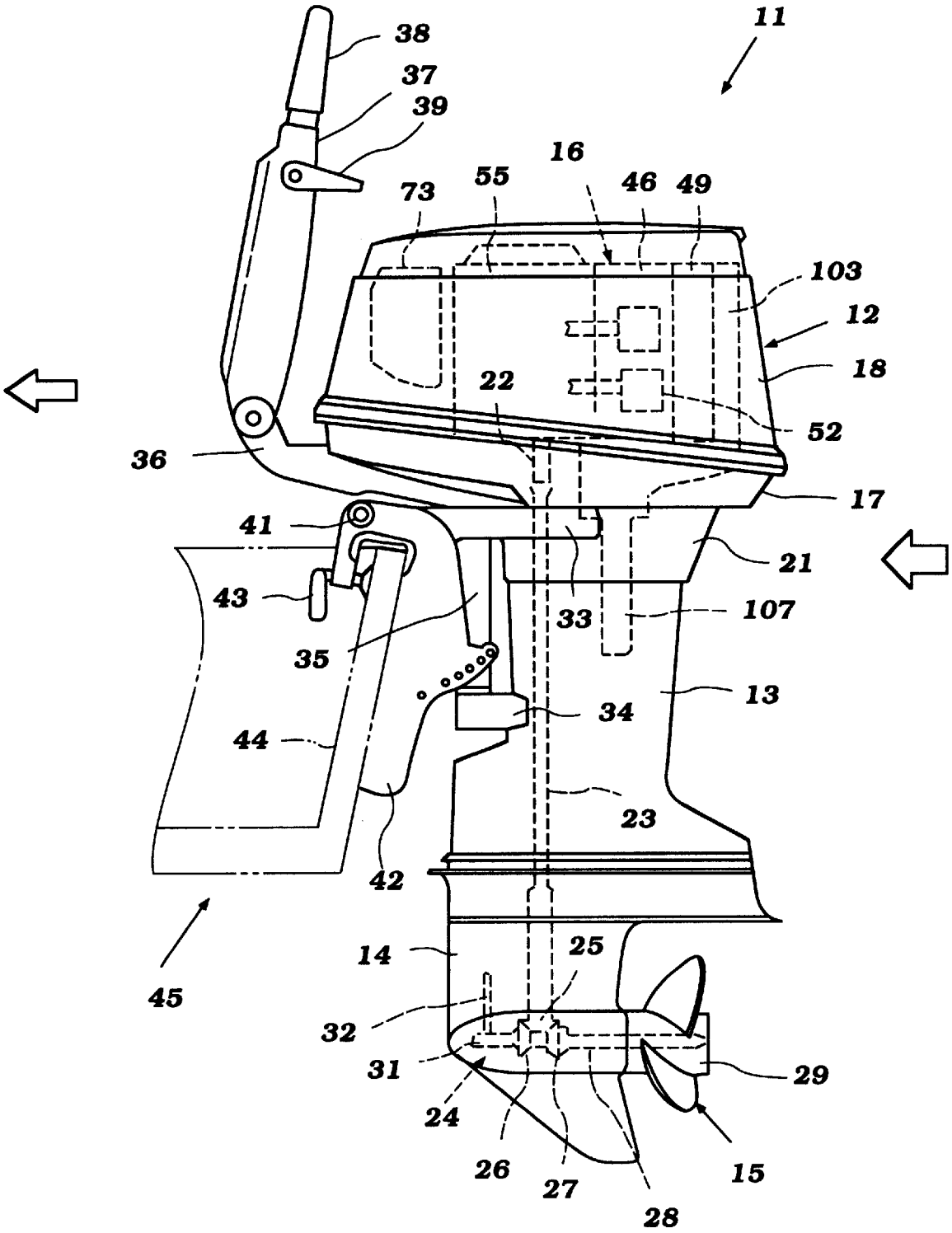
FIG. 1 is a side elevational view of an outboard motor constructed in accordance with a first embodiment of the invention shown attached to the transom of a watercraft, illustrated partially and in phantom.
Figure 2:
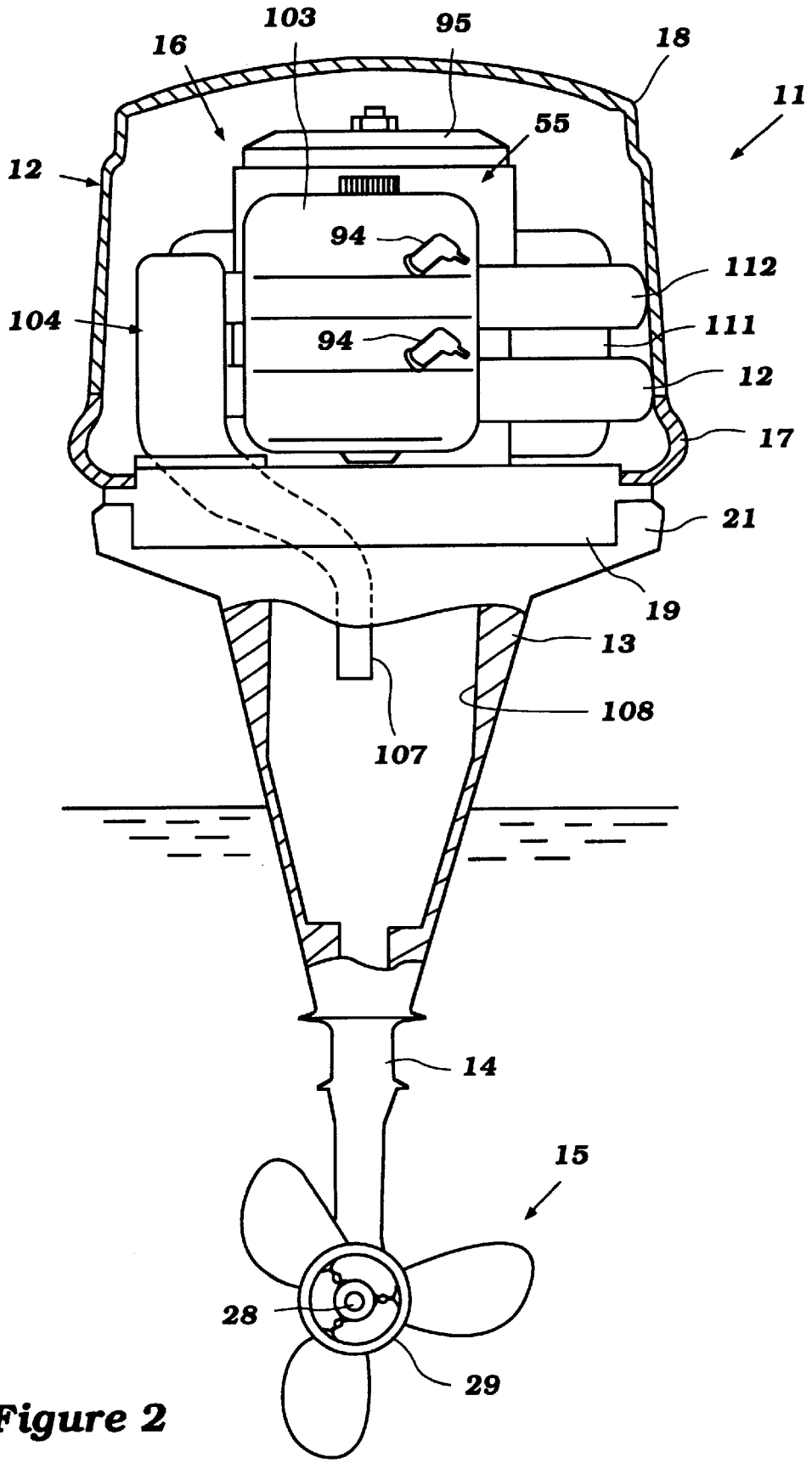
FIG. 2 is a rear elevational view of the outboard motor with portions broken away so as to more clearly show the construction.
Figure 3:
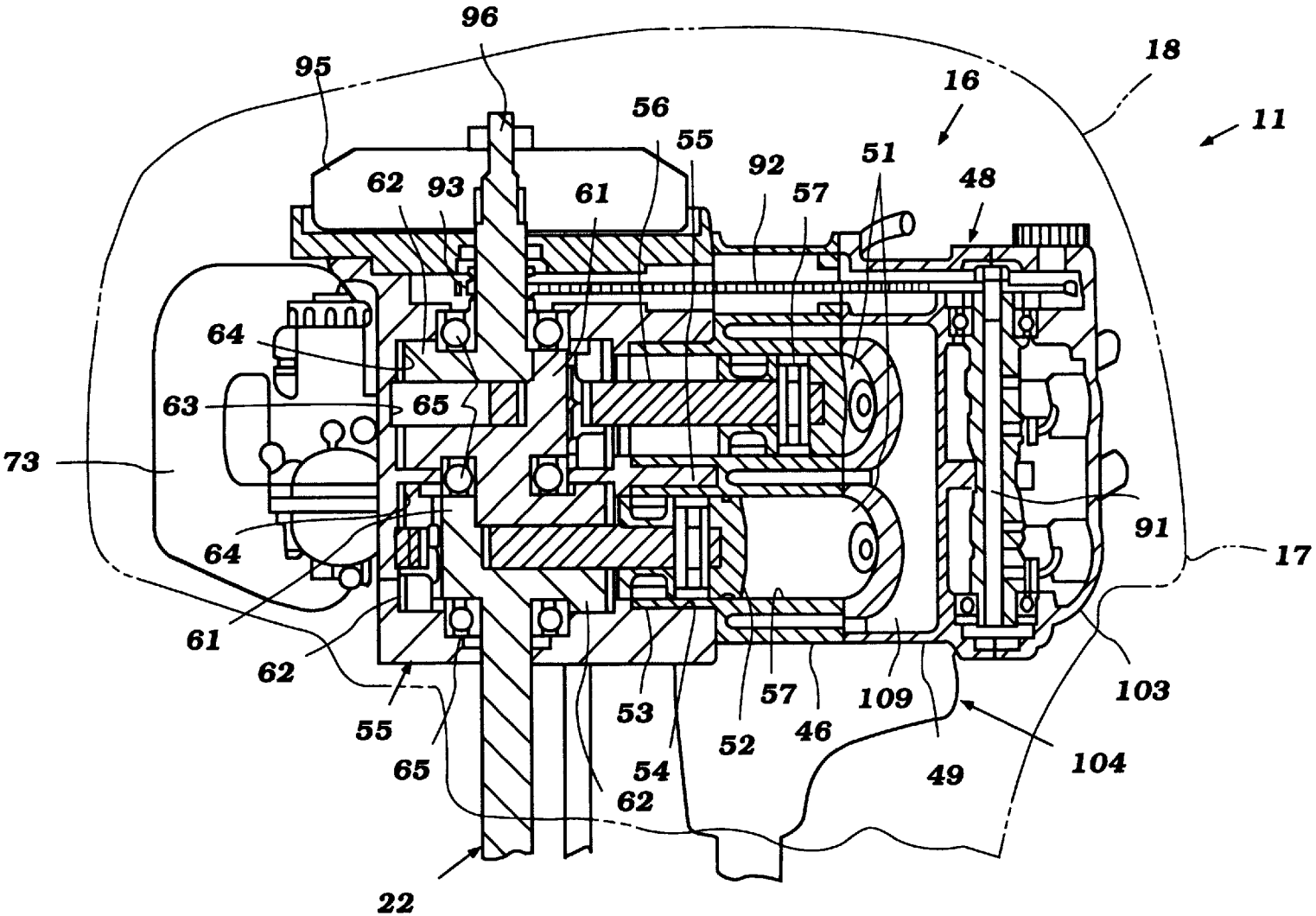
FIG. 3 is an enlarged cross-sectional view taken through the powerhead of the outboard motor with the engine shown in solid lines and the protective cowling shown in phantom.
Figure 4:
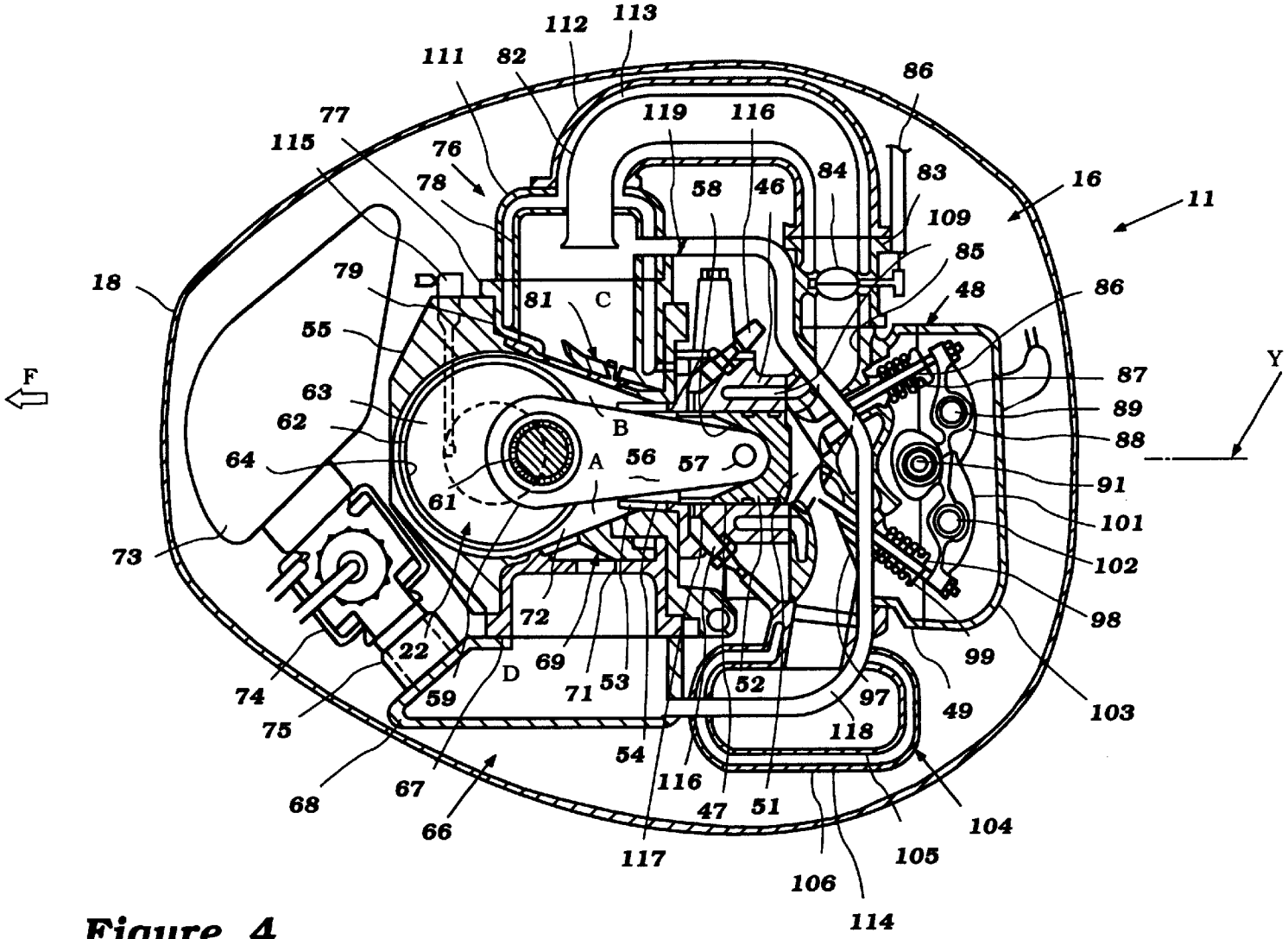
FIG. 4 is a cross-sectional view taken through the powerhead along a horizontal plane.

Referring first to the outboard motor embodiment of the invention as shown in FIGS. 1–4 and initially primarily to FIGS. 1 and 2, an outboard motor constructed in accordance with this embodiment is indicated generally by the reference numeral 11. The outboard motor 11, as with most outboard motors, is comprised of a powerhead, indicated generally by the reference numeral 12, that is disposed above a drive shaft housing/lower unit assembly comprised of a drive shaft housing 13 and a lower unit 14.

A propulsion device such as a propeller 15 is supported in the lower unit 14 in a manner to be described and is driven by an internal combustion engine, indicated generally by the reference numeral 16 which forms a major portion of the powerhead 12.

The powerhead 12, in addition to the engine 16, is comprised of a protective cowling that is comprised primarily of a lower tray portion 17 and an upper main cowling portion 18 that is detachably connected to the tray portion 17 in any known manner. The tray portion 17 is typically formed from a relatively high strength lightweight material such as aluminum or aluminum alloy. The main cowling portion 18, on the other hand, is formed from an even lighter weight but less strong material such as a molded fiberglass reinforced resin or the like.

As may be seen best in FIG. 2 and some of the later figures, the engine 16 is mounted on a spacer plate or exhaust guide 19 which is positioned in the upper end of the drive shaft housing 13. A shroud 21 may be formed around the upper portion of the drive shaft housing 13 and spacer plate 19 so as to provide a neater appearance for sealing purposes.

As is typical without outboard motor practice, the engine 16 is supported within the powerhead 12 upon the spacer plate 19 so that its output shaft, a crankshaft 22, rotates about a vertically extending axis. This facilitates coupling of the output shaft or crankshaft 22 to a drive shaft 23 which rotates about a generally vertically extending axis and which is journaled within the drive shaft housing 13 and lower unit 14.

In the lower unit 14, the drive shaft 23 drives a forward, neutral, reverse transmission, indicated generally by the reference numeral 24 and which may be of any known type. Basically, this transmission includes a driving bevel gear 25 that is fixed for rotation with the lower end of the drive shaft 23. This driving gear 25 drives a pair of diametrically opposed driven bevel gears 26 and 27 which rotate in opposite directions.

These driven bevel gears 26 and 27 are joumaled on a propeller shaft 28 to which a hub 29 of the propeller 15 is affixed in a known manner. A dog clutching mechanism of a known type is provided for selectively coupling either the gear 26 or the gear 27 to the propeller shaft 28 so as to drive the propeller 15 in a forward or reverse direction. When this dog clutching element is positioned in a neutral position, the gears 26 and 27 rotate freely on the propeller shaft 28 and no propulsion is provided. This shifting is accomplished by means of a shift plunger 31 that is operated by a shift rod 32. The shift rod 32 extends upwardly to a shift control lever (described later).

A steering shaft (not shown) is affixed to the drive shaft housing 13 by an upper bracket assembly 33 and a lower bracket assembly 34. This steering shaft is journaled for rotation in a swivel bracket 35 for steering of the outboard motor 11 in a known manner. A tiller 36 is affixed to the upper end of the steering shaft and has a pivoted tiller control 37 that includes a twist grip throttle 38 and a transmission shift lever 39, previously alluded to.

The swivel bracket 35 is, in turn, pivotally connected by a pivot pin 41 to a clamping bracket 42. Pivotal movement about the pivot pin 41 permits tilt and trim movement of the outboard motor 11, as is also known in the art. A clamping mechanism 43 is carried by the clamping bracket 42 for detachably affixing the outboard motor 11 to a transom 44 of a watercraft hull, shown partially and indicated generally by the reference numeral 45.

The construction of the outboard motor 11 as thus far described may be considered to be conventional. Where any details of the outboard motor 11 are not described, those skilled in the art can readily resort to any known type of construction with which to practice the invention. The invention deals primarily with the construction of the internal combustion engine 16 and that now will be described by principal reference to FIGS. 3 and 4 although certain of the components also appear in FIGS. 1 and 2. Where that is the case, the reference numerals applied to them will be carried over into these earlier figures.

The engine 16 is, in the illustrated embodiment, of a two-cylinder inline type. Although the invention is described in conjunction with a two-cylinder inline type engine, it should be readily apparent to those skilled in the art that the invention may be utilized in conjunction with any multiple number of cylinders and also may be utilized with engines having opposed V-type cylinder block arrangements. However, certain facets of the invention have particular utility in conjunction with inline engines because of the compact nature of the construction, which will become apparent as this description proceeds.

The engine 16 is comprised of a cylinder block, indicated by the reference numeral 46 and in which two horizontally disposed cylinder bores 47 are formed. One end of these cylinder bores 47 is closed by a cylinder head assembly, indicated generally by the reference numeral 48, which is detachably affixed, in the illustrated embodiment, to the cylinder block 46 in any known manner.

The cylinder head assembly 48 includes a main cylinder head casting 49 that is formed with individual recesses 51 which cooperate with the cylinder bores 47 and pistons 52 that are slidably supported therein to form the combustion chambers of the engine. Because of the fact that the cylinder head recesses 51 form the major portion of the combustion chamber volume at top dead center, the reference numeral 51 will at times also be utilized to identify the combustion chambers.

The cylinder block 46 has cylindrical extensions 53 around the cylinder bores 47 that are received within complimentary openings 54 of a crankcase member, indicated generally by the reference numeral 55. This crankcase member 55 is affixed to the cylinder block 46 in a known manner and functions, among other things, to close the ends of the cylinder bores 47 below the pistons 52.

Connecting rods 56 are connected by piston pins 57 to the pistons 52. The pistons 52 are formed with recessed areas 58 that are engaged by the small ends of the connecting rods 56 so as to form a pivoting seal between the ends of the connecting rods 56 and the pistons 52 for a reason which will be described.

The lower or big ends of the connecting rods 56, indicated by the reference numeral 59 are journaled on throws 61 of the crankshaft 22. Adjacent each throw 61, the crankshaft 22 is formed with disk-like members 62 that cooperate with the interior surface of the crankcase member 55 so as to define individual crankcase chambers 63 each of which is associated with a respective cylinder bore 47. The chambers 63 are basically sealed by sealing surfaces 64 disposed on opposite sides of each throw 61 and which cooperate with the crankshaft disk-like portions 62 to provide axial seals and to seal one crankcase chamber 63 from the other.

The crankshaft 22 is rotatably journaled in the crankcase member 55 by a plurality of main anti-friction bearings, indicated generally by the reference numeral 65. As described in the aforenoted U.S. Pat. No. 5,377,7634, the connecting rod 56 functions at times to divide the crankcase chamber 62 into a first, intake side A and a second, delivery side B.

An air charge is delivered to the intake side A by an induction system, indicated generally by the reference 66 and which is placed on one side of the engine 16. Basically, this induction system 66 is comprised of a charging chamber D that is disposed substantially entirely on one side of a plane Y that contains the axes of the cylinder bores 47 and the axis of rotation of the crankshaft 22.

The crankcase member 55 is formed at one side thereof with a portion of the chamber D and which is surrounded by an outstanding flange 67. A cover member 68 is detachably affixed to the crankcase member 55 and completes the definition of the intake chamber D.

This charging chamber D communicates the crankcase intake sides A through intake passages 69 through flow ports 71. The intake passages 69 are actually valved by the connecting rod 56 which at times closes a portion 72 of the crankcase chamber part A during the down stroke of the pistons 52.

As is well known in the outboard motor art, the main cowling member 18 is provided with an atmospheric air inlet opening which does not appear in the figures but which permits intake air to be drawn into the protective cowling. This air is then delivered to an intake device, indicated generally by the reference numeral 73 which disposed conveniently adjacent the lower end of the crankcase member 55 in an otherwise void area. This intake device 73 may provide a silencing function and, in turn, delivers the air charge to one or more carburetors 74.

The carburetors 74 have conventional circuits and may be of any known type. They, in turn, deliver a fuel/air charge to the charging chamber D through an inter-fitting coupling 74. Thus, a fuel/air charge is drawn through the intake system 66 into the crankcase chamber 63 during the upstroke of the pistons 52 much like in a two-cycle crankcase compression engine.

The charge which is drawn into the crankcase chamber 63 is trapped in the delivery side B when the connecting rod 56 and piston 52 move toward their bottom dead center positions. They then act to compress the charge and deliver it to a delivery system, indicated generally by the reference numeral 76 and which is disposed in totality on the other side of the plane Y from the intake system 66.

This delivery system is comprised of compression chamber C which functions much like a plenum chamber. This compression chamber C is formed by a recess formed in a portion 77 of the crankcase member 55 and which is closed on its outer surface by a closure plate 78. A double walled construction, as will be described later, encircles this for inter-cooling purposes.

A compressor port 79 is formed in the side of the crankcases member 55 communicating with this chamber C and is valved by the connecting rod 56 and a reed type valve assembly 81 so as to ensure trapping of the compressed charge in the chamber C.

A pair of intake pipes, indicated by the reference numeral 82 extend from within the compressor chamber C and curve along the delivery side 76 of the engine and terminate in a throttle body assembly 83. The throttle body assembly 83 includes a pair of butterfly-type throttle valves 84 that control the flow of charge to intake passages 85 formed on this same side of the engine 16. The throttle valves 84 are controlled by a remote throttle actuator through a boden wire cable 86.

Preferably the volume of the compression chamber C is equal to or greater than the volume of the intake pipes 82.

The intake passages 85 terminate at intake ports that are valved by intake valves 86 that are slidably supported in the cylinder head member 49 in a known manner. Coil compression springs 87 hold these intake valves 86 in their closed position. Intake rocker arms 88 are journaled in the cylinder head assembly 48 on intake rocker arm shaft 89. These rocker arms 88 are operated by the intake cams of a camshaft 91 that is journaled for rotation in the cylinder head assembly 49.

This camshaft 91 is driven at one-half crankshaft speed by a timing chain 92 that is engaged with a sprocket fixed to the upper end of the camshaft 91 and a sprocket affixed to the upper end of the crankshaft 22, which sprocket is indicated by the reference numeral 93. Hence, the charge which has been compressed in the crankcase chamber and stored in the compression chamber C will be delivered under pressure into the combustion chambers 51 when the intake valves 86 open on the intake stroke.

This charge will be further compressed in as the pistons 52 move toward their top dead center position on the compression stroke. The charge is then fired by spark plugs 94 that are mounted in the cylinder head assembly by means of an ignition system which may include flywheel magneto assembly 95 that is driven off of the upper end of the crankshaft 22 and is connected for rotation therewith by a coupling 96.

The charge which is ignited by the spark plugs 94 will bum and expand to drive the pistons 52 in a well known manner during the power stroke. During the exhaust stroke, the charge is discharged from the combustion chambers 51 through exhaust ports formed on the side of the cylinder head opposite to the intake passages 85 and which communicate with exhaust passages 97.

These exhaust ports are valved by exhaust valves 98 which are normally urged to a closed position by coil compression springs 99. These exhaust valves 98 are opened by exhaust rocker arms 101 joumaled on an exhaust rocker arm shaft 102 that is mounted in the cylinder head assembly 48. These exhaust rocker arms 101 are operated by exhaust cam lobes formed on the camshaft 91.

The valve actuating mechanism thus far described is contained within a chain valve actuating chamber that is closed by a cam cover 103 that is affixed to the cylinder head casting 49 and which completes the cylinder head assembly 48.

The exhaust gases that are discharged from the cylinder head passages 97 are delivered to an exhaust manifold assembly, indicated generally by the reference numeral 104. The exhaust manifold assembly 104 is positioned entirely on the opposite side of the plane Y from the delivery side 76 and is adjacent but spaced from the intake system 66. This exhaust manifold assembly 104 includes an inner shell 105 that forms a collector section and which is encircled by an outer shell 106 to provide cooling in a manner which will be described.

The manifold 104 extends downwardly and terminates in a discharge end 107 that extends into an expansion chamber 108 formed in the drive shaft housing 103. The exhaust gasses are discharged to the atmosphere from this expansion chamber 108 through a suitable discharge system which may include a through-the-propeller hub underwater discharge and a more restricted above-the-water low speed discharge. Such systems are well known in the art and since they form no significant part of the invention, further description is not believed to be necessary.

The engine 16 is water cooled and water for its cooling is drawn from the lower unit 14 by a water pump driven off of the lower end of the drive shaft 23 in a well known manner. The cylinder block 46 and cylinder head 49 are formed with cooling jackets 109 through which this water is circulated. In addition, the compressor chamber C is surrounded by an outer shell 111 which cooperates with further shells 112 that encircle the intake pipes 82 to define a cooling jacket 113.

Coolant is circulated through the cooling jacket so as to cool the intake charge and to act, in effect, as an inter-cooler. In a similar manner, the outer shell 106 around the exhaust manifold 105 forms a cooling jacket 114 through which cooling water is also circulated.

The engine 16 may be provided with a suitable lubricating system and this includes a lubricant injector 115 that supplies lubricant to the crankshaft 22 and its bearings for their lubrication. In addition, cylinder injectors 116 are mounted in the cylinder block 46 and spray through ports 117 so as to lubricate the piston 52 and other portions of the engine.

Advantageously, the engine 16 is also provided with a system which permits bypassing of the compression in the crankcase chambers 63 or, alternatively, reduction of the pressure in the compressor chamber C. To this end, there is provided a bypass passage 118 that extends from the compressor chamber C back to the intake chamber D. A control valve 119 is provided in this passage and can be operated either by a pressure control system or in any other suitable manner so as to limit the maximum compression pressure exerted.

Figure 5:
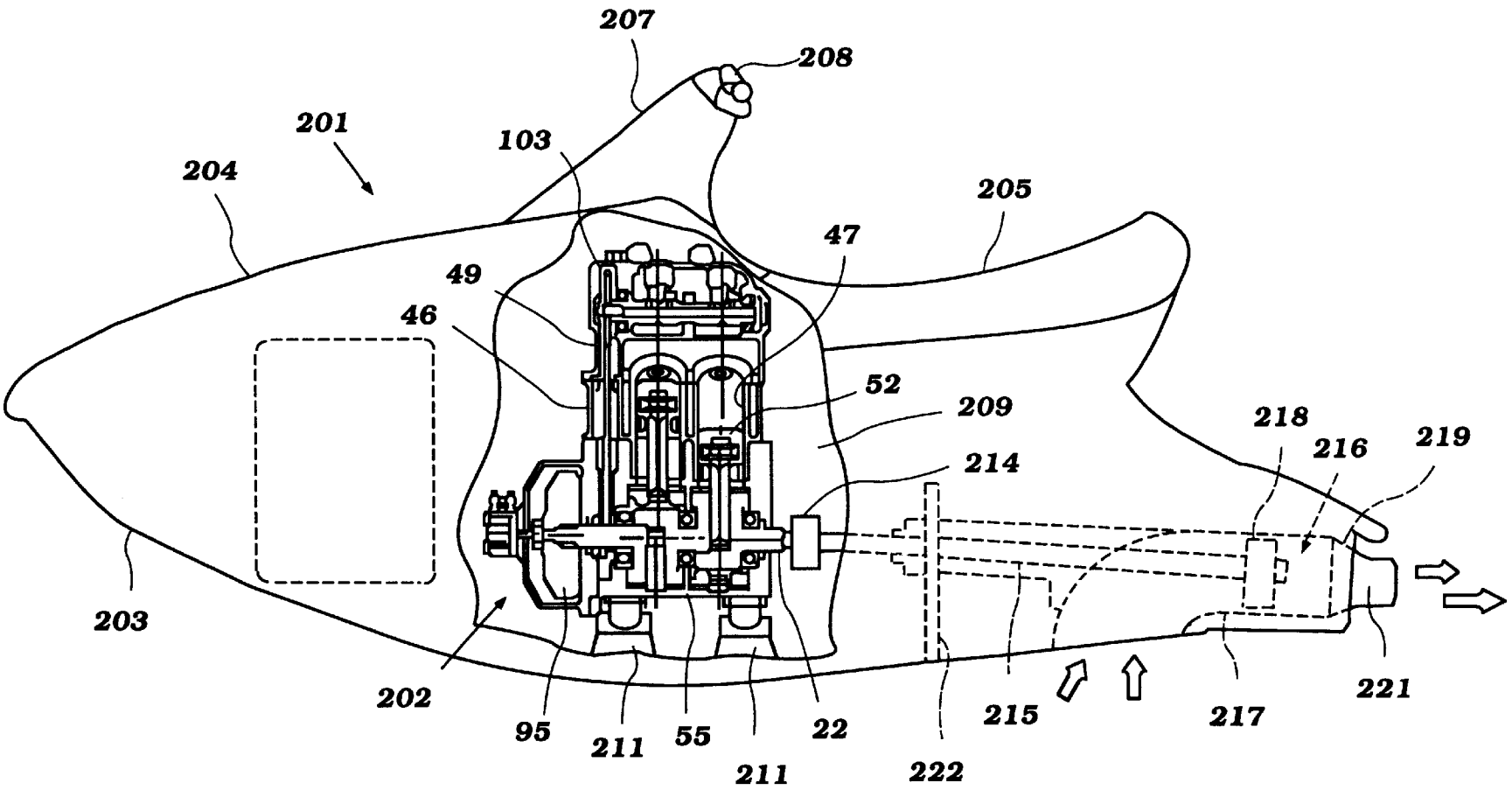
FIG. 5 is a side elevational view of a personal watercraft powered by an engine constructed in accordance with an embodiment of the invention, with a portion broken away and with the engine shown in cross-section.
Figure 6:
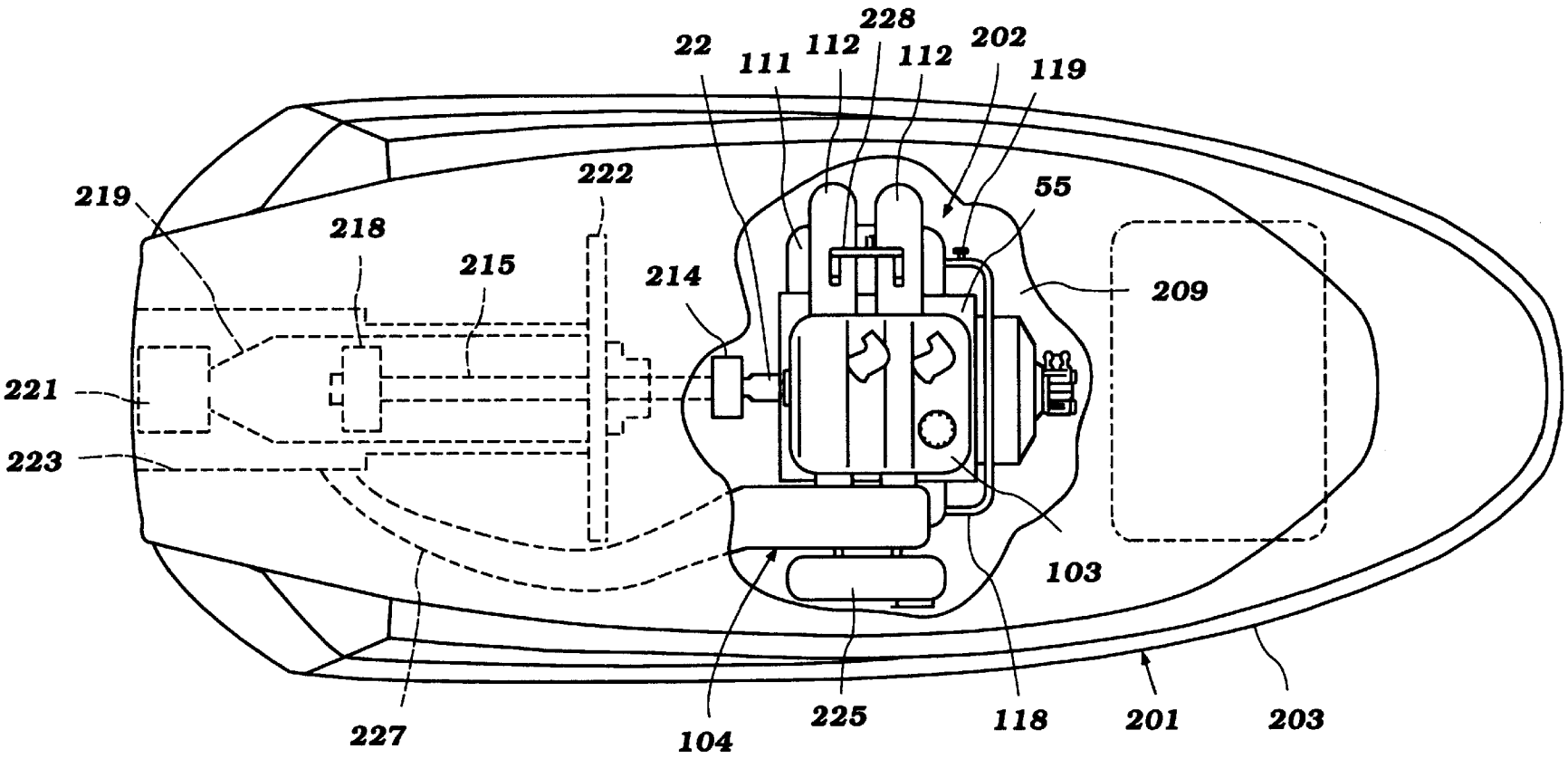
FIG. 6 is a top plan view of the watercraft with a portion broken away so as to more clearly show the installation of the engine therein.
Figure 7:
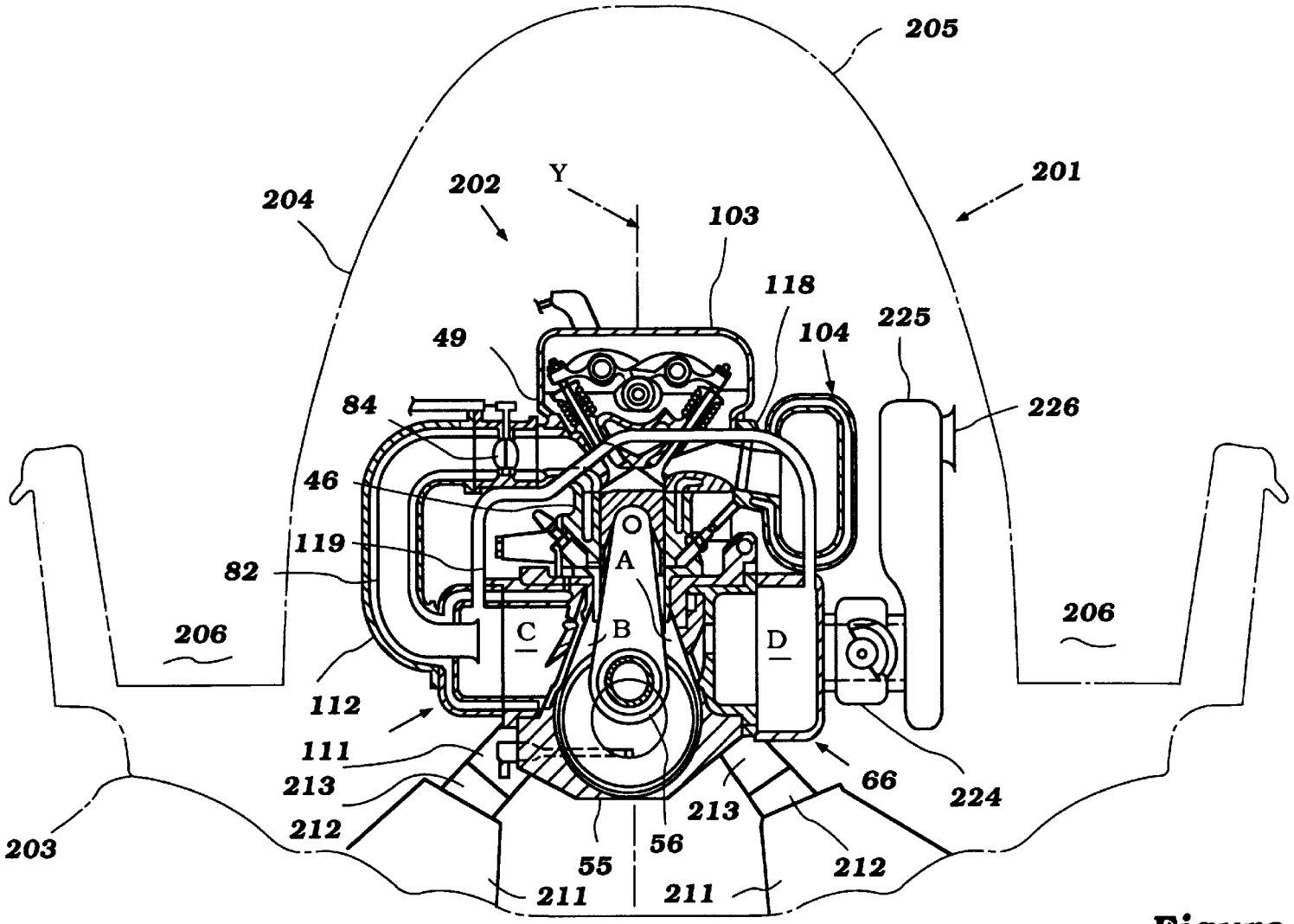
FIG. 7 is a cross-sectional view taken along a transverse plane through the watercraft and specifically through the engine with the engine shown in solid lines and the watercraft body shown in phantom.

Inboard Propulsion System (FIGS. 5–7)

The compact nature of the construction of the engine 16 obviously lends itself to application as the power plant for an outboard motor as with the outboard motor 11. Also, the relatively high specific output lends itself to this application. The invention also may be used as an inboard propulsion system and has particular utility in conjunction with small watercraft of the type conventionally referred to as "personal watercraft."

Such a watercraft is shown in FIGS. 5–7 and is identified generally by the reference numeral 201. It is to be understood that the configuration of the watercraft 201 illustrated is just typical of many of the types of personal watercraft or other small watercraft with which the engine may be employed.

The engine in this embodiment is indicated generally by the reference numeral 202. The basic construction of the engine 202 is the same as that of the engine 16 in the outboard motor 11. Where components are the same or substantially the same, they are indicated by the same reference numerals and will be described again in conjunction with this embodiment only insofar as necessary to understand how the engine 202 is associated with the watercraft 201.

Basically, only the external components and in this case certain portions of the intake system and of the exhaust system differ from the previously described, outboard motor embodiment. Therefore, if any components of the engine 202 are not described or illustrated they may be assumed to be the same as the engine 16.

The watercraft 201 is comprised of a hull that is made up of a lower, hull part 203 and an upper, deck part 204. These hull parts 203 and 204 are formed from a suitable material such as a molded fiberglass reinforced resin or the like. They define at their rear end a passenger's compartment which is comprised primarily of an elevated seat 205 that is adapted to accommodate one or more riders seated in straddle fashion. The hull is provided with foot areas 206 on the sides of this raised seat portion 205 for accommodating the feet of the riders. These foot areas 206 may open through the rear of the watercraft 201 so as to facilitate entry and exit from the body of water in which the watercraft 201 is operating.

A mast 207 extends upwardly at the front of the seat 205 and carries a handlebar assembly 208 for control of the watercraft 201.

The area under the mast 207 and under the forward portion of the seat 205 forms an engine compartment 209 in which the engine 202 is mounted. The hull in this area is provided with pedestals 221 that accommodate engine mounts 212 that cooperate with bearing blocks 213 formed integrally with or attached to the crankcase member 55 so as to support the engine.

In this embodiment, the engine is mounted so that the crankshaft 22 rotates about a generally horizontally disposed axis. The crankshaft 22 is coupled by a flexible coupling 214 to an impeller shaft 215 of a jet propulsion unit, indicated generally by the reference numeral 216.

The jet propulsion unit 216 includes an outer housing 217 that is mounted in a tunnel formed in the under part of the hull portion 203 and which defines a downwardly facing water inlet portion through which water is drawn from the body of water in which the watercraft is operating as indicated by the arrows in FIG. 5.

An impeller 218 is affixed to the trailing end of the impeller shaft 215 for pumping this water and discharging it through a discharge nozzle portion 219. A steering nozzle 221 cooperates with this discharge nozzle portion 219 and directs the direction of water flow rearwardly. The steering nozzle 221 is steered by the handlebar assembly 208 for steering of the watercraft 201 in a manner well known in this art.

The tunnel area in which the jet propulsion unit 216 is mounted is defined at its forward end by a bulkhead 222 through which the impeller shaft 215 extends. This tunnel appears partially in FIG. 6 and is identified generally by the reference numeral 223.

As has been noted, internally the engine 202 is the same as the engine 16 from the outboard motor application. However, the external components are somewhat rearranged and hence, the air supply chamber D indicated by the reference numeral 66 is supplied by one or more carburetors 224 that are of the side draft type. These carburetors 224 are served by an air inlet device 225 which, because of the placement of the engine, is disposed on the same side of the engine as the intake system 66 but extends vertically upwardly and has an upwardly position air inlet opening 226. This assists in ensuring against water ingestion. This part of the air inlet device 225 is positioned transversely outwardly of the exhaust manifold 104. This still results in a compact assembly as should be readily apparent from the figures.

In addition, in this embodiment the exhaust manifold 104 delivers the exhaust gases to an exhaust pipe 227 (FIG. 6) which extends rearwardly along one side of the engine and which discharges into the tunnel 223. Thus, a neat exhaust system is provided and the exhaust gases are conveniently discharged in the area of the water level and in a concealed area.

This embodiment also incorporates a balance passage 228 which interconnects the intake pipes 82 and balances the intake airflow between the respective cylinders 47.

Figure 8:
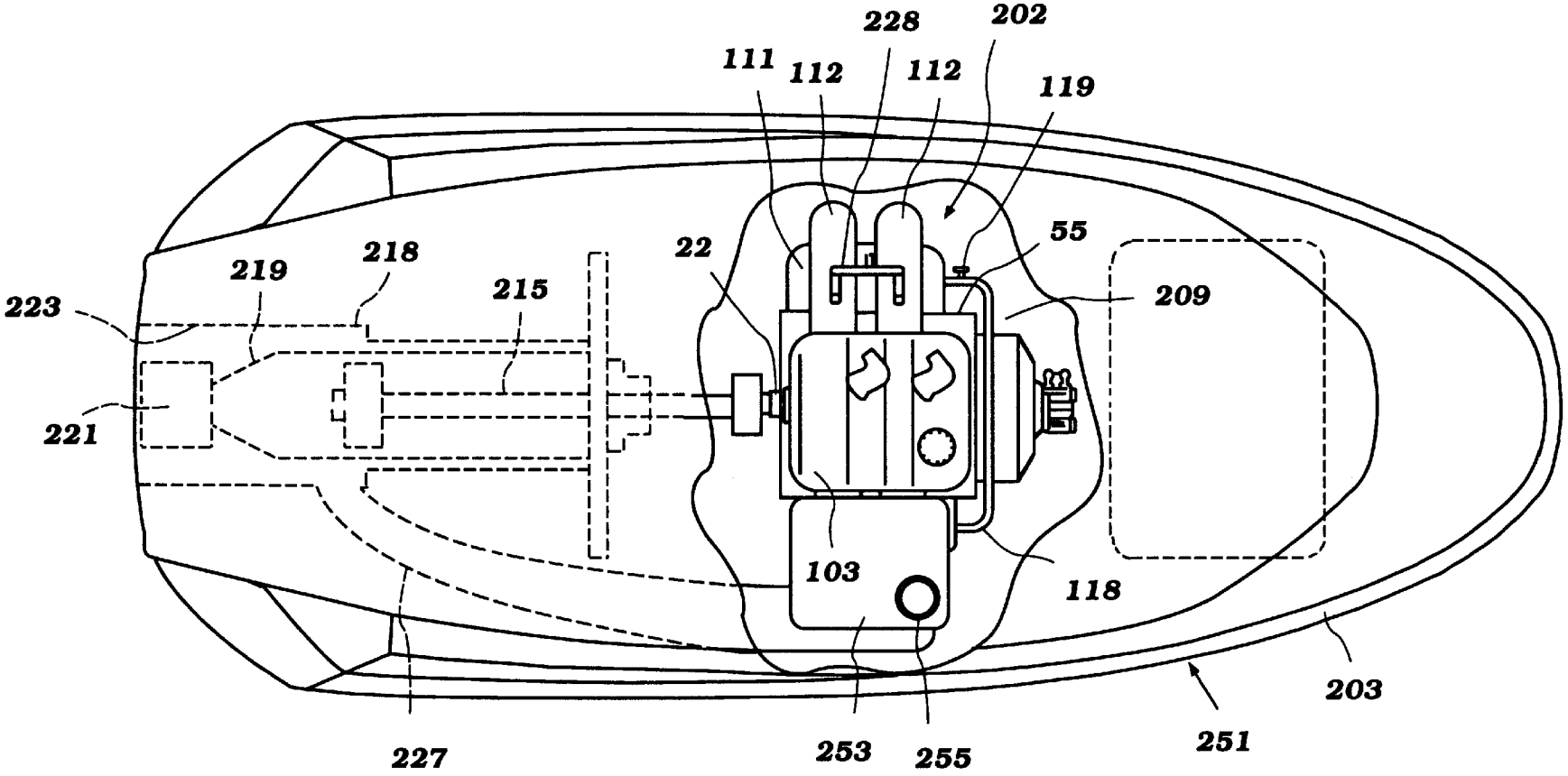
FIG. 8 is a broken way top plan view, in part similar to FIG. 6, and shows another embodiment of the invention as applied to a watercraft.
Figure 9:
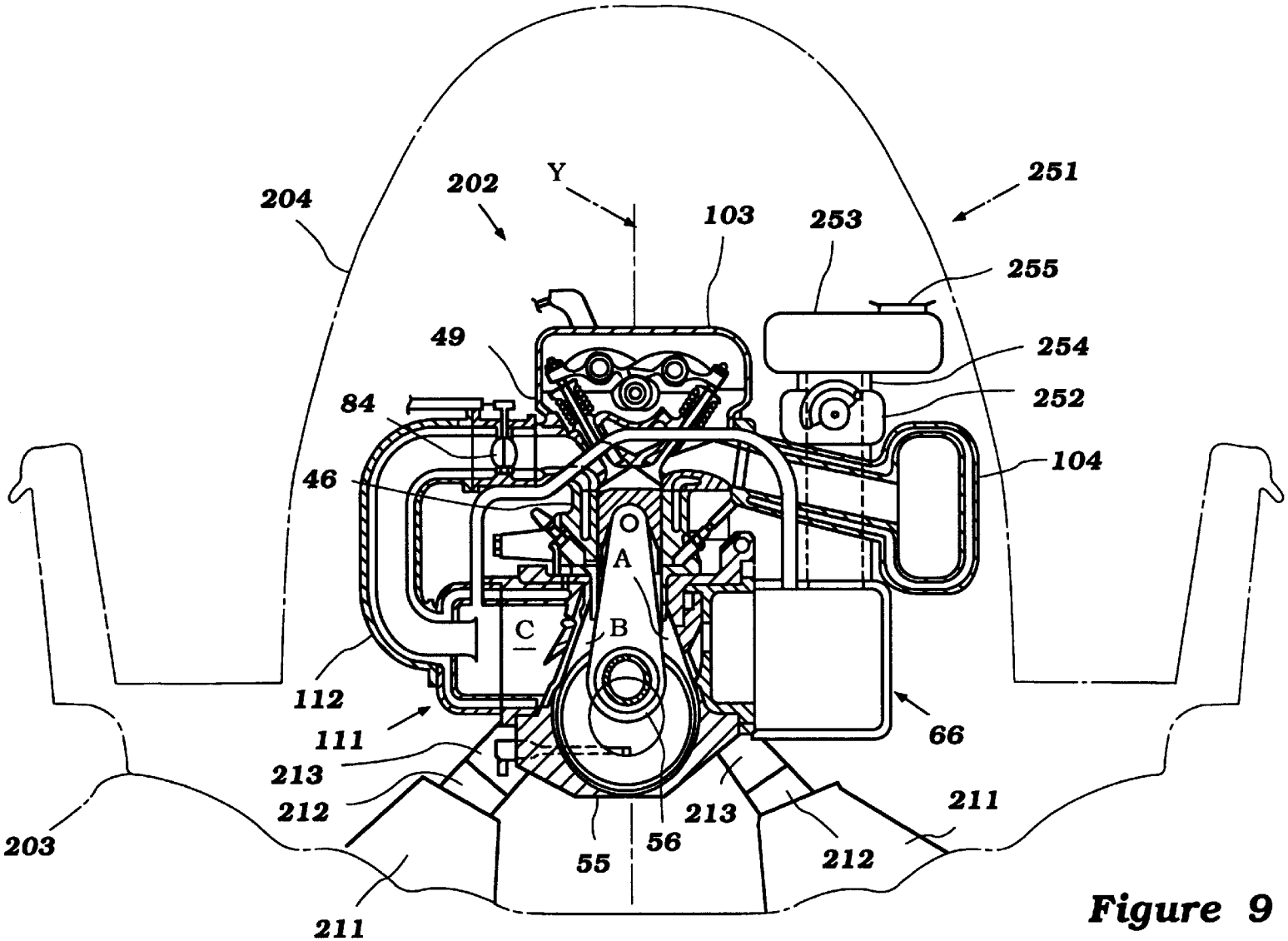
FIG. 9 is a cross-sectional view, in part similar to FIG. 7, but showing the watercraft of FIG. 8.

Second Watercraft Embodiment (FIGS. 8 and 9)

A watercraft constructed in accordance with a second embodiment of watercraft application is shown in FIGS. 8 and 9 and is indicated generally by the reference numeral 251. This embodiment differs from the previously described embodiment only in the location of the carburetors and the air inlet device. Therefore, all other components of this watercraft have been identified by the same reference numerals and those components which are the same as those already described will be described again, only insofar as is necessary to relate them to this embodiment.

In this embodiment, the air inlet chamber is provided with one or more downdraft carburetors 252 which are disposed vertically above the air inlet device 66 and also above the exhaust manifold 104. In order to accommodate this, the exhaust manifold 104 is extended transversely outwardly from the engine a greater extent than with the previously described embodiment.

An air delivery box 253 supplies the carburetor or carburetors 252 through discharges 254. An atmospheric air inlet opening 255 is formed in the upper end of the air inlet box 253 and is suitably shrouded so as to preclude water from entering the induction system.

Thus, from the foregoing description it should be readily apparent that the described embodiments of the invention provide very compact and nevertheless high output fourcycle engines because of their incorporation of crankcase compression. Also, it should be readily apparent that the specific watercraft illustrated and/or the specific outboard motor application are merely typical of the environments in which this compact engine construction may be utilized.

Of course, the foregoing description is that of preferred embodiments of the invention, and various changes and modifications may be made without departing from the spirit and scope of the invention, as defined by the appended claims.

What is claimed is:

1. A four cycle, internal combustion engine comprised of a cylinder block having a plurality of cylinder bores with crankcase chambers formed at one end thereof, a cylinder head closing the other end of said cylinder bores, a plurality of pistons each reciprocating in a respective one of said cylinder bores and forming with said cylinder bores and said cylinder head a plurality of combustion chambers, a crankshaft rotatably journalled in said crankcase chamber, a plurality of connecting rods each coupled to a respective one of said pistons and said crankshaft for transmitting motion therebetween, means for providing a seal between one end of each of said connecting rods and the respective one of said pistons and between the sides of said connecting rods and the side surfaces of said crankcase chamber, said connecting rods each having a portion thereof in sealing engagement with said crankcase during at least a portion of a single rotation of said crankshaft for dividing said crankcase chamber into a plurality of pairs of variable volume chambers formed solely by said pistons, said cylinder bores, said connecting rods, said crankshaft and said crankcase chamber for acting as a positive displacement pump, intake means for admitting an air charge to said crankcase chambers at one side of said engine, delivery means for discharging a compressed air charge from said crankcase chamber at the other side of said engine, a compressor chamber fixed contiguous to said crankcase chambers at said other side of said engine for receiving the compressed charge therefrom, said cylinder head having a plurality of intake ports on said other side of said engine for serving said combustion chambers, means for supplying a compressed charge from said compressor chamber to said intake ports entirely located on said other side of said engine comprising a plurality of intake pipes each extending from spaced inlet ends formed within said compressor chamber and externally therefrom to said intake ports along said cylinder block in spaced relation thereto, a plurality of exhaust passages formed in said cylinder head on said one side of said engine for discharging exhaust products from said combustion chambers, and an exhaust manifold on said one side of said engine for collecting the exhaust gasses from said exhaust passages.

2. A four cycle, internal combustion engine as set forth in claim 1, wherein the intake means for admitting the air charge to the crankcase chamber comprises intake ports disposed on the one side of said engine and the delivery means for discharging a compressed charge from the crankcase chambers comprises discharge ports disposed on the other side of said engine and opening into the compressor chamber.

3. A four cycle, internal combustion engine as set forth in claim 2, wherein at least one of the connecting rods and the crankshaft acts as a valve element for opening and closing one of said ports.

4. A four cycle, internal combustion engine as set forth in claim 1, wherein the crankcase chamber is defined in part by a cylindrical surface and one end of the connecting rods have a curved surface in sealing engagement with said cylindrical surface during a portion of the rotation of the crankshaft.

5. A four cycle, internal combustion engine as set forth in claim 4, wherein the other ends of the connecting rods have a curved surface in constant sealing engagement with a complimentary curved surface of the respective piston for providing the seal between said pistons and said connecting rods.

6. A four cycle, internal combustion engine as set forth in claim 5, wherein the crankshaft has a pair of facing sealing surfaces in sealing engagement with opposite sides of the connecting rods throughout the rotation of the crankshaft for providing at least in part the seal between said connecting rods and said crankcase chamber.

7. A four cycle, internal combustion engine as set forth in claim 1, further comprising an induction system at least in part on the one side of the engine for delivering the air charge to the crankcase chamber.

8. A four cycle, internal combustion engine as set forth in claim 7, wherein the induction system is entirely on the one side of the engine.

9. A four cycle, internal combustion engine comprised of a cylinder block having a plurality of cylinder bores with crankcase chambers formed at one end thereof, a cylinder head closing the other end of said cylinder bores, a plurality of pistons each reciprocating in a respective one of said cylinder bores and forming with said cylinder bores and said cylinder head a plurality of combustion chambers a crankshaft rotatable journalled in said crankcase chamber, a plurality of connecting rods each coupled to a respective one of said pistons and said crankshaft for transmitting motion therebetween, means for providing a seal between one end of each of said connecting rods and the respective one of said pistons and between the sides of said connecting rods and the side surfaces of said crankcase chamber, said connecting rods each having a portion thereof in sealing engagement with said crankcase during at least a portion of a single rotation of said crankshaft for dividing said crankcase chamber into a plurality of pairs of variable volume chambers formed solely by said pistons, said cylinder bores, said connecting rods, said crankshaft and said crankcase chamber for acting as a positive displacement pump, intake means for admitting an air charge to said crankcase chambers at one side of said engine, an induction system at least in part on said one side of said engine for delivering said air charge to said crankcase chamber, and including an air inlet device positioned adjacent said crankcase chamber on the side opposite said cylinder bores delivery means for discharging a compressed air charge from said crankcase chamber at the other side of said engine, a compressor chamber located at said other side of said engine for receiving the compressed charge therefrom, said cylinder head having a plurality of intake ports on said other side of said engine for serving said combustion chambers, means for supplying a compressed charge from said compressor chamber to said intake ports entirely located on said other side of said engine, a plurality of exhaust passages formed in said cylinder head on said one side of said engine for discharging exhaust products from said combustion chambers, and an exhaust manifold on said one side of said engine for collecting the exhaust gasses from said exhaust passages.

10. A four cycle, internal combustion engine as set forth in claim 1, further including a bypass passage extending from the compression chamber to the delivery chamber and valve means in said bypass passage for controlling the pressure of the charge delivered from the cylinder head intake passages.

11. A four cycle, internal combustion engine as set forth in claim 1, wherein the engine is water cooled and the cylinder block and cylinder head have cooling jackets through which liquid coolant is circulated.

12. A four cycle, internal combustion engine as set forth in claim 11, wherein the compressor chamber is formed with a cooling jacket through which liquid coolant is circulated for intercooling the compressed charge.

13. A four cycle, internal combustion engine as set forth in claim 12, wherein the intake pipes are also formed with a cooling jacket through which liquid coolant is circulated for intercooling the compressed charge.

14. A four cycle, internal combustion engine as set forth in claim 13, wherein the exhaust manifold is also formed with a cooling jacket through which liquid coolant is circulated.

15. A four cycle, internal combustion engine as set forth in claim 11, wherein the exhaust manifold is formed with a cooling jacket through which liquid coolant is, circulated.

16. A four cycle, internal combustion engine as set forth in claim 1, in combination with a marine propulsion device driven by the crankshaft.

17. The combination of claim 16, wherein the crankshaft rotates about a vertical axis and the marine propulsion device is located below the engine.

18. The combination of claim 17, wherein the combination comprises an outboard motor and the engine is encircled by a protective cowling to form a power head, and the marine propulsion device comprises a propeller journalled in a lower unit and driven by a drive shaft and a bevel gear transmission.

19. The combination of claim 16, wherein the crankshaft rotates about a horizontal axis and the propulsion device is located at one end of the engine.

20. The combination of claim 19, wherein the combination further includes a hull in which the engine and marine propulsion unit are mounted.

21. The combination of claim 20, wherein the marine propulsion unit comprises a jet pump.

* * * * *